US010728673B2

(12) United States Patent
Panni et al.

(10) Patent No.: US 10,728,673 B2
(45) Date of Patent: Jul. 28, 2020

(54) LOUDSPEAKER WITH CLOSED MEMBRANE AND RELATIVE ASSEMBLY METHOD

(71) Applicant: ASK INDUSTRIES SOCIETA' PER AZIONI, Monte San Vito (AN) (IN)

(72) Inventors: Claudio Panni, Monte San Vito (IT); Dario Cinanni, Senigallia (IT); Manrico Colonna, Monte San Vito (IT)

(73) Assignee: ASK INDUSTRIES SOCIETA' PER AZIONI, Monte San Vito (AN) (IT)

( * ) Notice: Subject to any disclaimer, the term of this patent is extended or adjusted under 35 U.S.C. 154(b) by 0 days.

(21) Appl. No.: 16/167,679

(22) Filed: Oct. 23, 2018

(65) Prior Publication Data

US 2019/0124449 A1 Apr. 25, 2019

(30) Foreign Application Priority Data

Oct. 23, 2017 (IT) ..... 102017000118890

(51) Int. Cl.

| | |
|---|---|
| ***H04R 9/06*** | (2006.01) |
| ***H04R 31/00*** | (2006.01) |
| ***H04R 9/04*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/18* (2013.01); *H04R 9/025* (2013.01); *H04R 9/041* (2013.01); *H04R 9/043* (2013.01); *H04R 31/006* (2013.01); *H04R 2400/11* (2013.01)

(58) Field of Classification Search

CPC . H04R 9/06; H04R 7/18; H04R 9/025; H04R 9/041; H04R 31/006; H04R 2400/11

USPC ..... 381/398

See application file for complete search history.

(56) References Cited

U.S. PATENT DOCUMENTS

| | | | | |
|---|---|---|---|---|
| 2013/0308815 | A1* | 11/2013 | Alvarez Ibarra | H04R 7/18 381/386 |
| 2015/0117698 | A1* | 4/2015 | Bullimore | H04R 7/16 381/398 |
| 2015/0271604 | A1* | 9/2015 | Busenitz | H04R 7/02 381/398 |
| 2016/0012783 | A1 | 1/2016 | Kimura et al. | |
| 2016/0057543 | A1* | 2/2016 | Salvatti | H04R 9/043 381/398 |
| 2016/0066098 | A1* | 3/2016 | North | H04R 9/043 381/398 |
| 2016/0127832 | A1* | 5/2016 | Chou | H04R 7/16 381/398 |

FOREIGN PATENT DOCUMENTS

| | | | |
|---|---|---|---|
| EP | 178703 | A1 | 4/1986 |

* cited by examiner

*Primary Examiner* — Sean H Nguyen

(74) *Attorney, Agent, or Firm* — Egbert, McDaniel & Swartz, PLLC

(57) ABSTRACT

An assembly method of a loudspeaker with closed membrane provides for preassembling a mobile unit having two centering devices fixed to a voice coil; pre-assembling a fixed unit that has a basket fixed to a magnetic unit, assembling the mobile unit in the fixed unit, by a centering device; extracting the centering device and fixing a closed membrane to the voice coil and to the basket.

9 Claims, 21 Drawing Sheets

LOUDSPEAKER WITH CLOSED MEMBRANE AND RELATIVE ASSEMBLY METHOD

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to a loudspeaker with closed membrane and to the relative assembly method.

2. Description of Related Art Including Information Disclosed Under 37 CFR 1.97 and 37 CFR 1.98

As it is known, a loudspeaker comprises a voice coil composed of a cylindrical support with at least one winding. The voice coil is connected to a membrane. An annular edge connects the membrane peripherally to a basket. The voice coil moves in a magnetic field, making the membrane vibrate to generate a sound.

Generally speaking, the membrane is open and has a truncated-conical shape with an axial hole wherein the voice coil is inserted. However, also loudspeakers with closed membrane (without axial hole) are provided, wherein the membrane covers the cylindrical support of the voice coil. In such a case, the membrane can have a different shape other than the truncated-conical one, being, for example, a planar or domed membrane.

In the following description, the terms "upper" and "lower" refer to the arrangement of the loudspeaker in the figures. Obviously, after being assembled, the loudspeaker can be disposed in any position.

FIG. 1 is an exploded view of a mobile unit (A) of a loudspeaker comprising a membrane (1), a voice coil (2) and a centering device (3). The membrane (1) is of open type and has a truncated-conical shape with an axial hole (10). An edge (11) is disposed peripherally on the membrane (1).

With reference to FIG. 2, the mobile unit (A) is pre-assembled, connecting the voice coil (2) to the membrane (1) and to the centering device (3). A fixed unit (B) comprises a magnetic unit (4) and a basket (5). Also the fixed unit (B) is pre-assembled.

The magnetic unit (4) comprises:

a lower polar plate (T-yoke) (40) with a core (41), a magnet (42) with toroidal shape disposed around the core (41), and an upper polar plate (43) with toroidal shape disposed on the magnet (42) and around the core (41).

An air gap (T) is defined as a cylindrical space between the external lateral surface of the core (41) and the internal lateral surface of the upper polar plate (43). The air gap (T) must be as small as possible in order to avoid induction losses of the magnetic flow.

The mobile unit (A) is mounted in the fixed unit (B), in such a way as to center the voice coil (2) in the air gap (T) of the magnetic unit. In order to ensure a correct positioning of the voice coil (2) in the air gap (T) of the magnetic unit (4), a centering device (6) is used, being generally composed of a sheet of a semi-rigid material folded in cylindrical shape. A rigid cylindrical element made of plastics or metal can be also used as centering device.

With reference to FIG. 3, the centering device (6) is disposed inside the voice coil (2) and fitted on the core (41) of the magnetic unit, in such a way as to ensure that the voice coil (2) is perfectly centered in the air gap (T).

A peripheral portion of the centering device (3) and the edge (11) of the membrane are glued to the basket (5), generally by means of glue. It must be noted that the mobile unit (A) is fixed to the fixed unit (B) at two spaced-out gluing planes, in such a way as to ensure a perfect centering of the voice coil in the air gap.

During the polymerization of the glue, the centering device (6) is maintained inside the voice coil (2), in such a way as to ensure a perfect centering of the voice coil in the air gap (T).

With reference to FIG. 4, when the polymerization of the glue is finished, the centering device (6) is extracted from the voice coil (2) through the axial hole (10) of the membrane.

With reference to FIG. 5, the axial hole (10) of the membrane is closed by an anti-dust dome (12) applied to the membrane or to an upper edge of the voice coil.

With reference to FIGS. 6 and 6A, the voice coil (2) comprises the cylindrical support (20) and the winding (21). A first distance (T1) is provided between the external surface of the core (41) and the internal surface of the cylindrical support (2) of the voice coil. A second distance (T2) is provided between the external surface of the winding (21) of the voice coil and the internal surface of the upper polar plate (43).

The distances (T1, T2) must be as small as possible, but at the same time the voice coil (2) must be prevented from touching the core (41) or the upper polar plate (42) in order to avoid distortions of the generated sound. Because of the centering device (6) and because of the fact that the mobile unit (A) is fixed to the basket at two levels, the air gap (T) and consequently the distances (T1, T2) can be minimized.

However, in the case of loudspeakers with closed membrane (without axial hole), the closed membrane cannot be pre-assembled in the mobile unit because the membrane would completely cover the hole of the cylindrical support of the voice call and the centering device could not be extracted from the top from the cylindrical support of the voice call.

In the following description, the parts that are identical or corresponding to the parts described above are identified with the same numerals, omitting their detailed description.

FIGS. 7-11 show an assembly method of a loudspeaker with closed membrane (100). In such a case, the membrane (100) is not provided with axial hole and it is planar, for instance.

With reference to FIG. 7, in such a case the pre-assembled mobile unit (A) only comprises the centering device (3) that is fixed to the voice coil (2).

With reference to FIGS. 8 and 9, the centering device (6) is disposed inside the voice coil (2) and fitted on the core (41) of the magnetic unit; then, the peripheral portion of the centering device (3) is glued to the basket (5).

With reference to FIG. 10, after the polymerization of the glue is finished, the centering device (6) is extracted from the top from the voice coil (2).

With reference to FIG. 11, after extracting the centering device, the membrane (100) is fixed to the fixed unit (B) and to the voice coil (2), gluing the edge (11) of the membrane to the basket (5) and a central portion of the membrane to the upper edge of the voice coil.

However, in such a case, during the permanence of the centering device (6) in the voice coil, the mobile unit (A) is fixed to the fixed unit (B) only at one gluing level. Because of this, it is not possible to maintain the voice coil centered in the air gap (T) during the following extraction step of the centering device (6) and the fixing step of the membrane (100). Consequently, the air gap (T) must be larger than in the case of a loudspeaker with open membrane.

With reference to FIGS. 12 and 12A, in this case of loudspeaker with closed membrane (100), a first distance (T3) is provided between the external surface of the core (41) and the internal surface of the cylindrical support (2) of the voice coil. A second distance (T4) is provided between the external surface of the winding (21) of the voice coil and the internal surface of the upper polar plate (43).

However, the distances (T3, T4) obtained with loudspeakers with closed membrane are considerably larger than the distances (T1, T2) obtained with loudspeakers with open membrane. Generally speaking, the distances (T3, T4) obtained with loudspeakers with closed membrane are at least double than the distances (T1, T2) obtained with loudspeakers with open membrane. It must be considered that for loudspeakers with closed membrane and high travel of the voice coil, the distances (T3, T4) are more than the triple of the distances (T1, T2) obtained with loudspeakers with open membrane.

The increase of the distances (T3, T4), which is necessary in loudspeakers with closed membrane, increases the dimension of the air gap (T), with a consequent induction loss of the magnetic flow and a reduction of the performance of the loudspeaker.

In order for a loudspeaker with closed membrane to have a performance similar to a loudspeaker with open membrane, a larger magnet must be used, or an additional magnet must be added, for example on the core of the upper polar plate, thus increasing costs and volumes of the loudspeaker.

EP1178703 discloses a loudspeaker with a membrane made of three separate portions:

- a central portion with open conical shape, which is fixed to the cylindrical support of the voice coil in such a way as not to cover the axial hole of the cylindrical support, and to two centering devices suitable for being fixed to the basket;
- a peripheral portion with open conical shape, which is fixed to the central portion of the membrane and to an edge suitable for being fixed to the basket; and
- an upper portion with closed planar shape, which is fixed to the peripheral membrane.

The central portion of the membrane, which is directly connected to the cylindrical support of the voice coil, does not cover the axial hole of the cylindrical support of the voice coil. Therefore, in order to center the voice coil in the air gap, a centering device (like the centering device (6) that is described above) can be used. In fact, such centering device can be extracted from the hole of the cylindrical support of the voice coil and successively the upper portion of the membrane is fixed on the central portion of the membrane.

US2016/0127832 discloses a loudspeaker with an open membrane, with conical shape, which is directly fixed to the cylindrical support of the voice coil, in such a way as not to cover the axial hole of the cylindrical support of the voice coil.

The purpose of the present invention is to eliminate the drawbacks of the prior art, by providing as assembly method of a loudspeaker with closed membrane, which is capable of minimizing the air gap and the relative distances of the voice coil in the air gap, in such a way as to maximize the performance of the loudspeaker while reducing the costs and the volume of the loudspeaker.

These purposes are achieved according to the invention with the characteristics of the independent claims.

Advantageous embodiments of the invention appear from the dependent claims.

BRIEF SUMMARY OF THE INVENTION

The peculiarity of the assembly method of a loudspeaker with closed membrane according to the invention consists in the fact that the pre-assembly step of the mobile unit comprises the fixing of a first centering device and of a second centering device to the cylindrical support of the voice coil.

Moreover, the gluing step of the mobile unit to the basket of the fixed unit comprises the gluing of the first centering device and of the second centering device to the basket, in such a way that the two centering devices are disposed along parallel planes, in order to guarantee a centering of the voice coil in the air gap and minimize a first distance between the external surface of the core and the internal surface of the cylindrical support of the voice coil, and a second distance between the external surface of the winding of the voice coil and the internal surface of the upper polar plate.

BRIEF DESCRIPTION OF THE SEVERAL VIEWS OF THE DRAWINGS

Additional features of the invention will appear manifest from the detailed description below, which refers to merely a illustrative, not limiting embodiment, as illustrated in the attached figures, wherein.

DETAILED DESCRIPTION OF THE INVENTION

Figure 1:
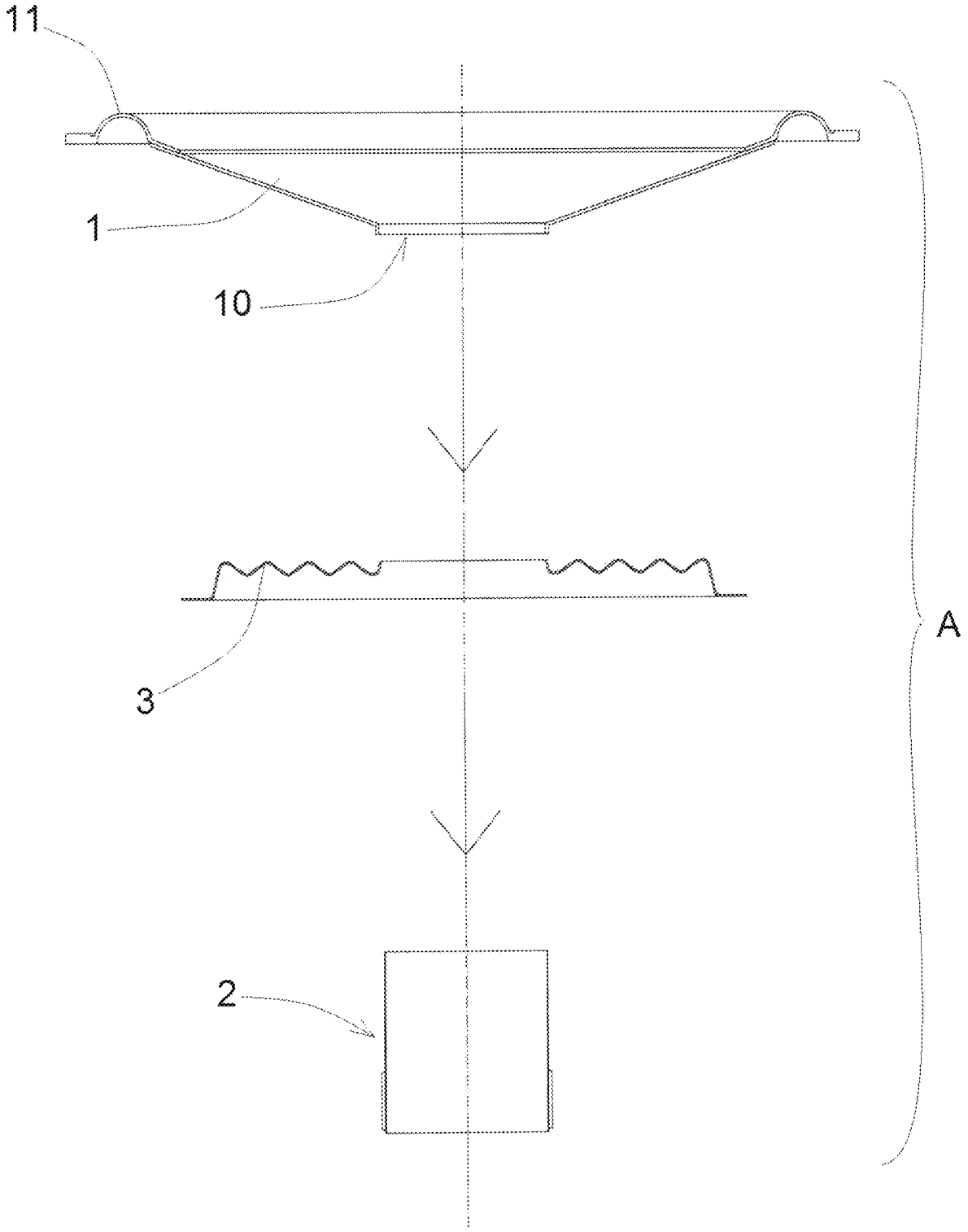
FIGS. 1-5 are diagrammatic axial views showing an assembly method of a loudspeaker with open membrane according to the prior art.
Figure 2:
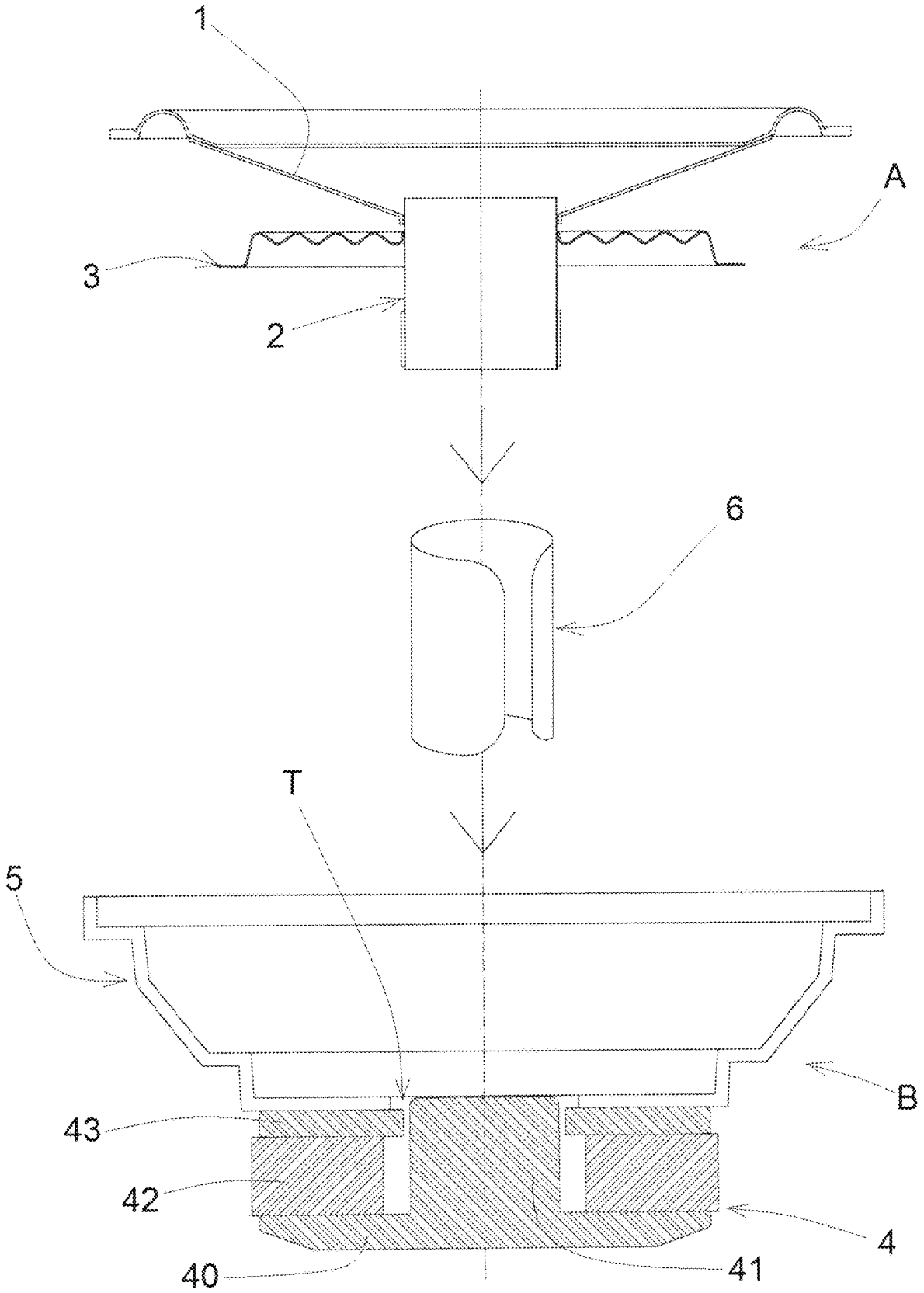
Figure 3:
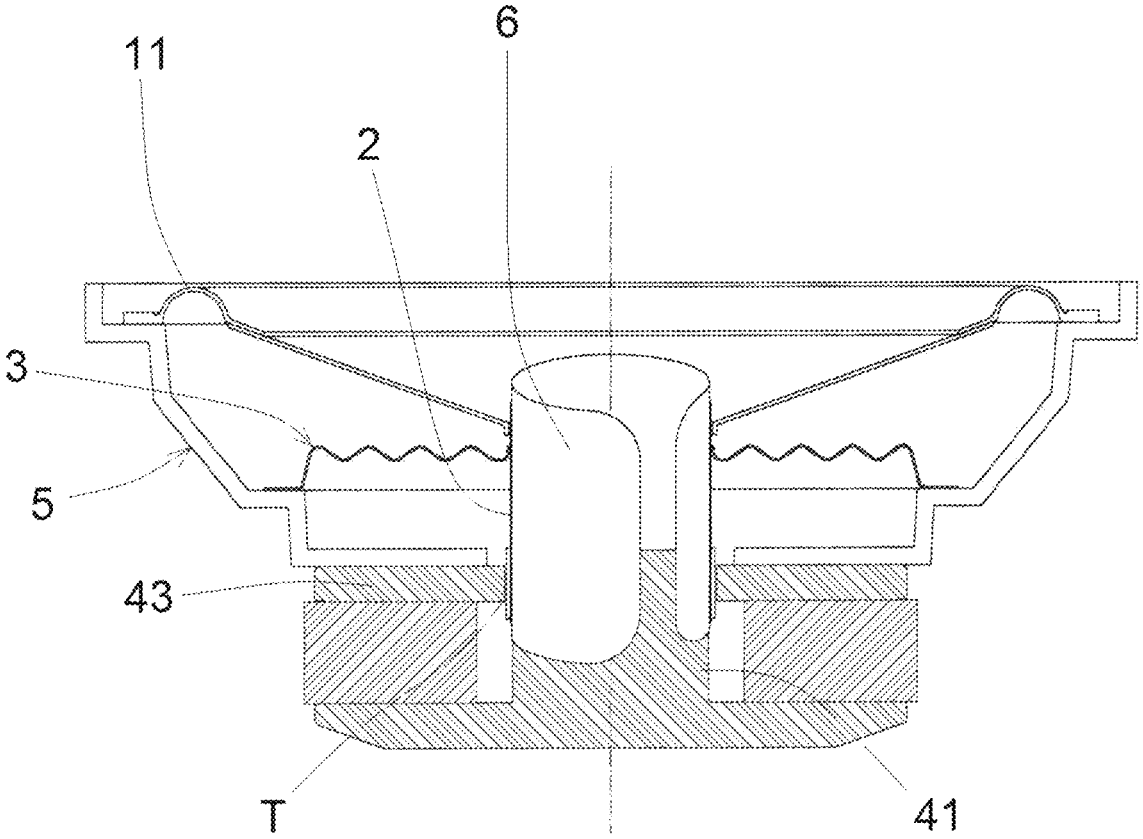
Figure 4:
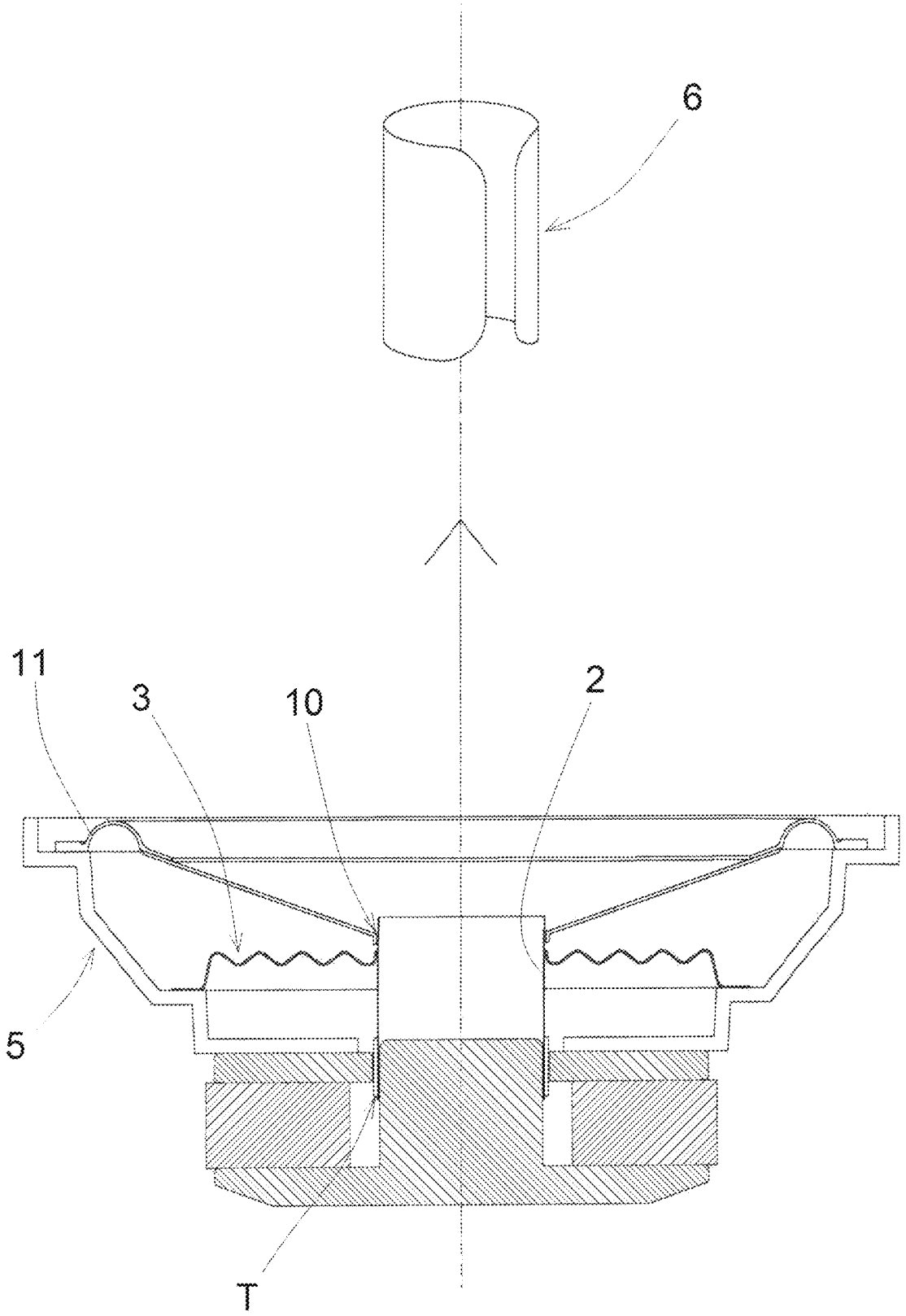
Figure 5:
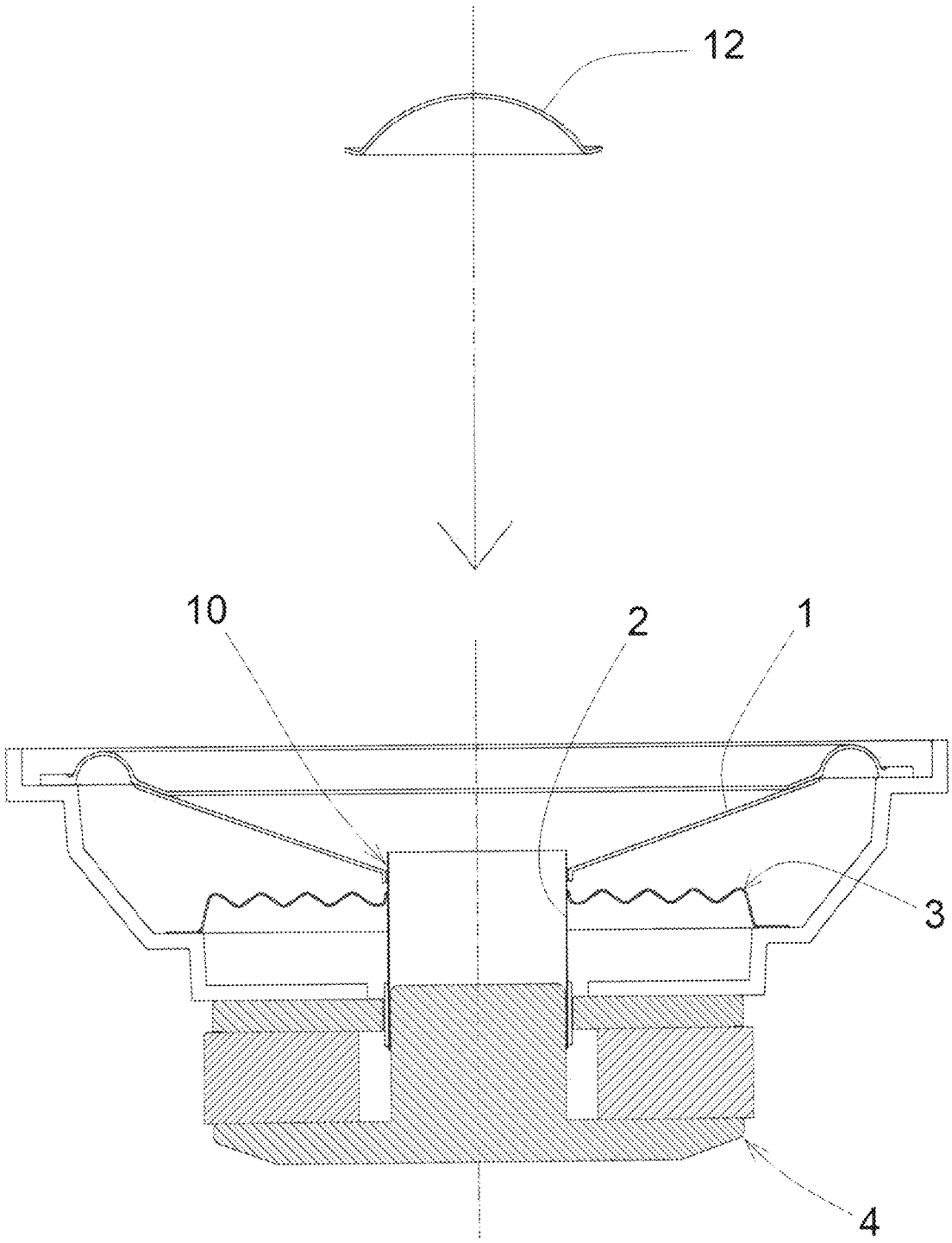
Figure 6:
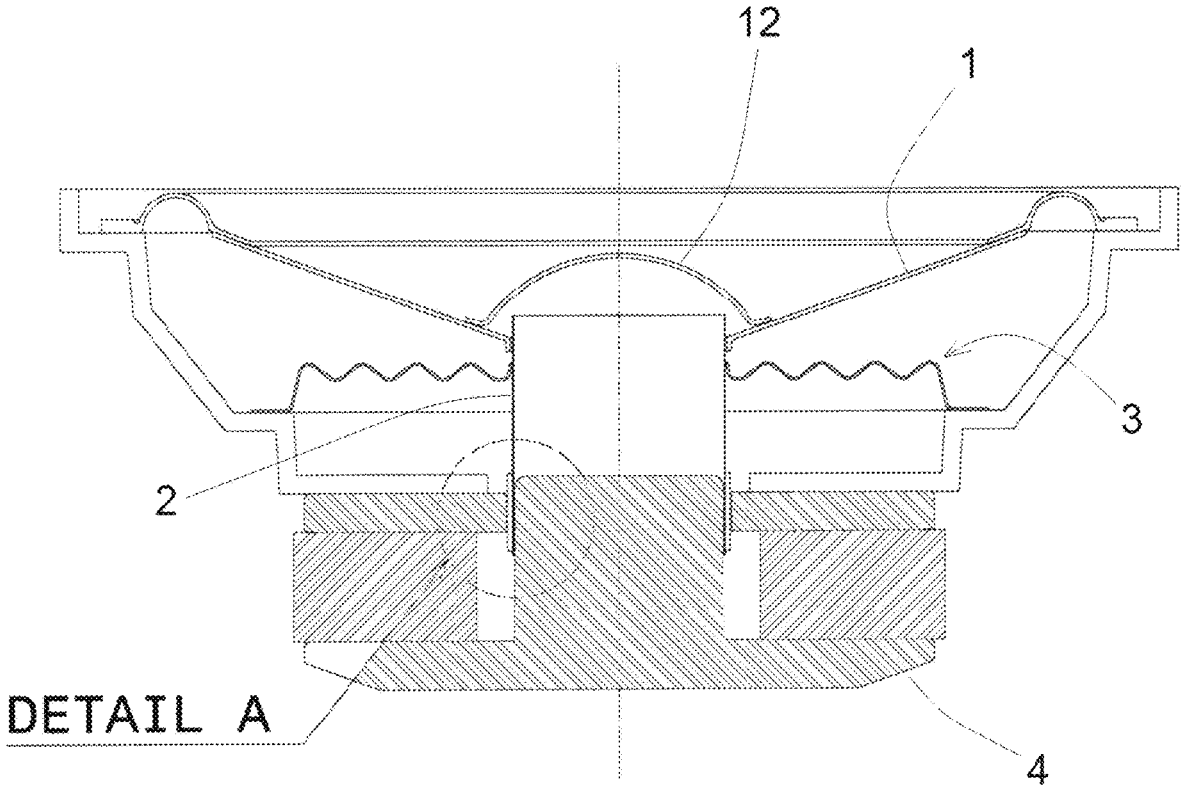
FIG. 6 is a diagrammatic axial view of a loudspeaker with open membrane, in assembled condition, according to the prior art.
Figure 6A:
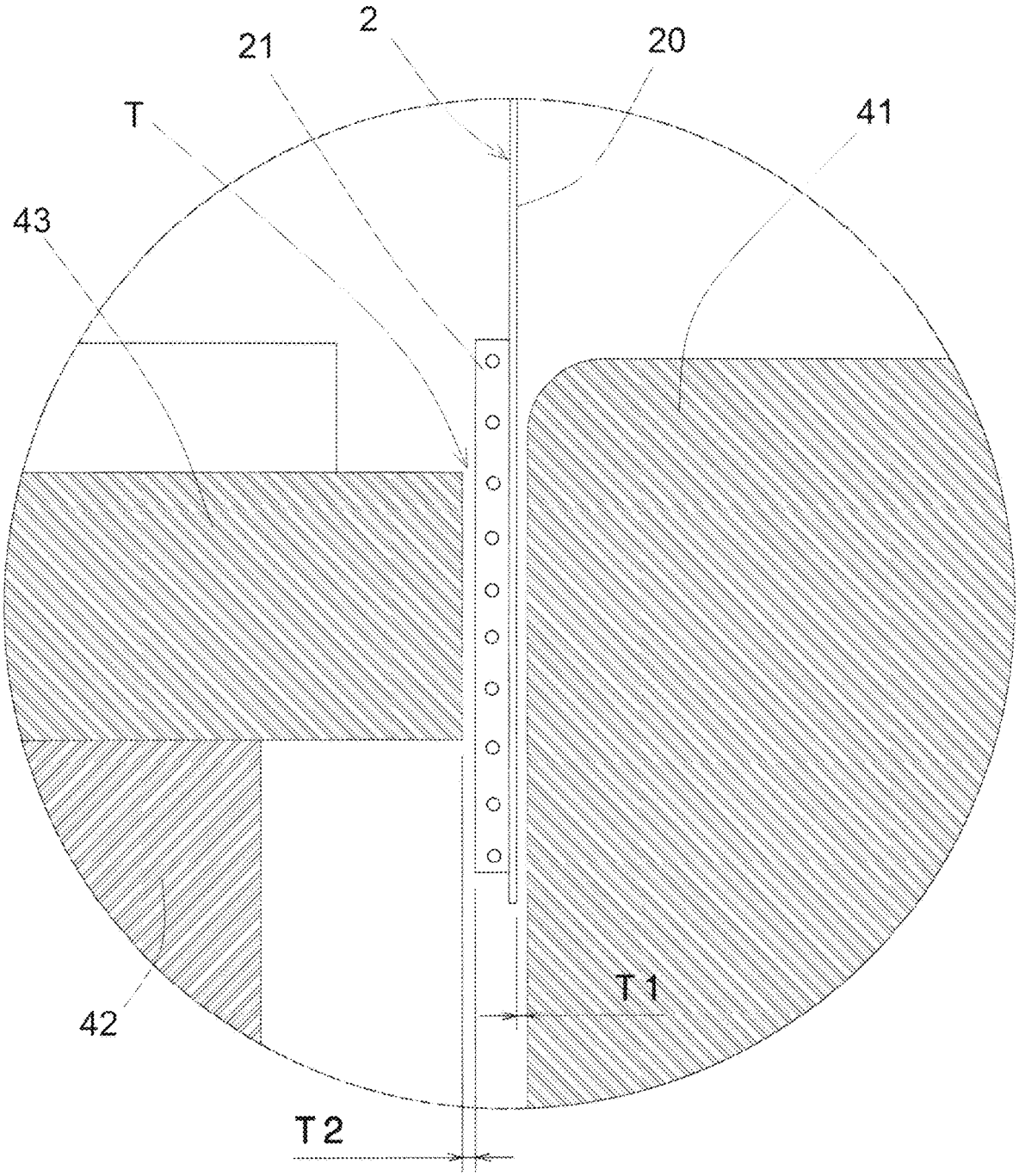
FIG. 6A is an enlarged view of a detail of the loudspeaker of FIG. 6.
Figure 7:
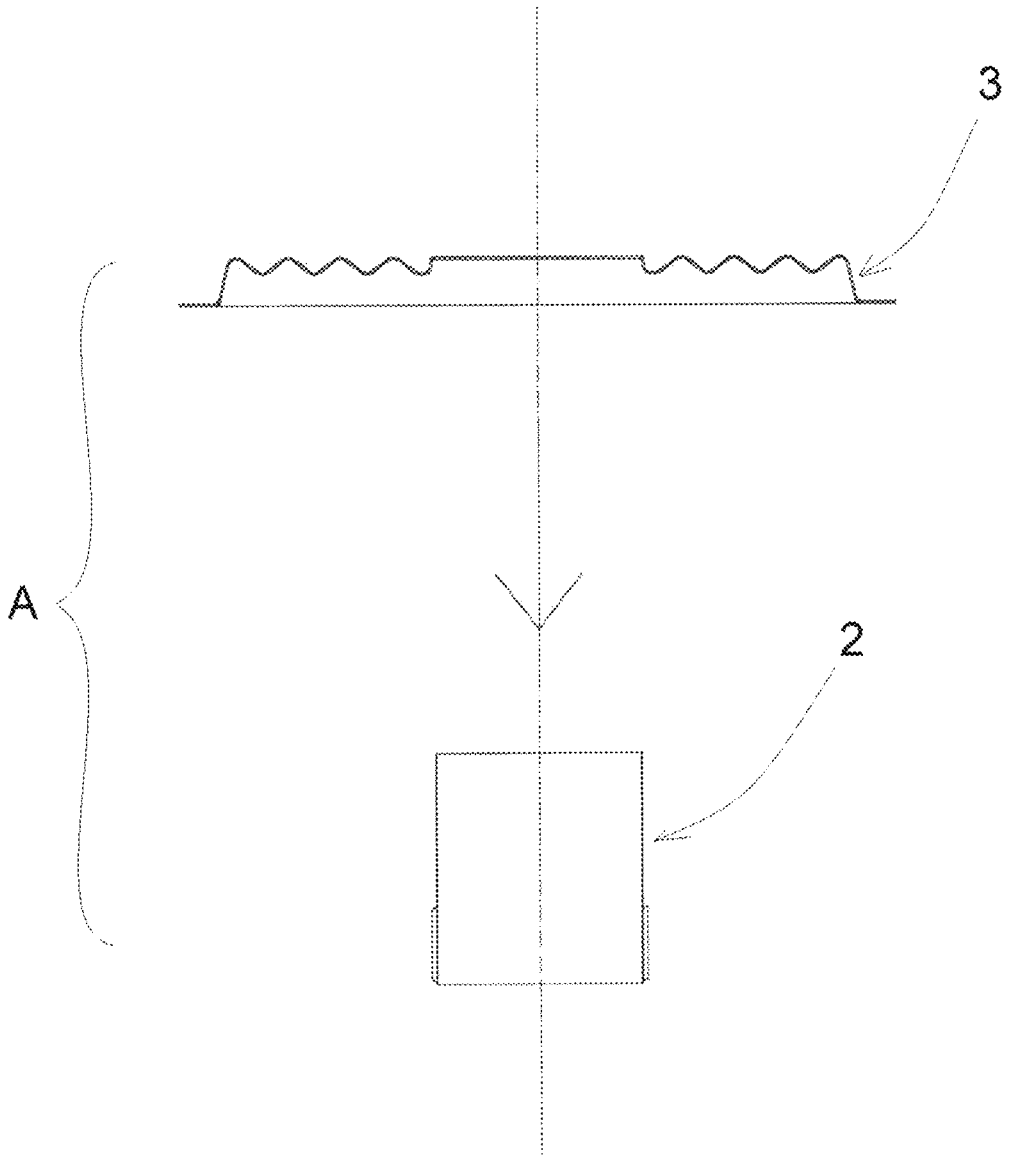
FIGS. 7-11 are diagrammatic axial views showing an assembly method of a loudspeaker with closed membrane, according to the prior art.
Figure 8:
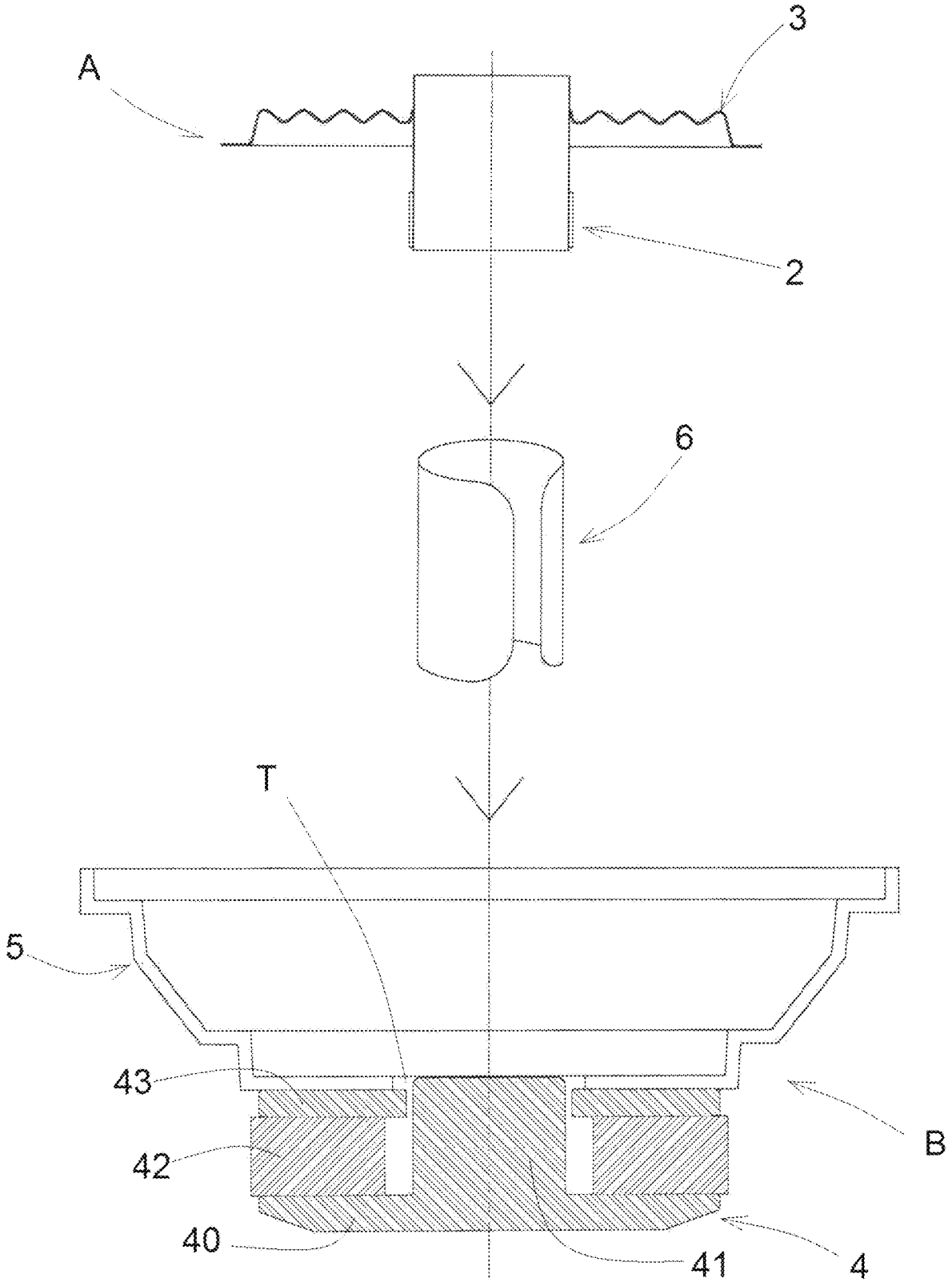
Figure 9:
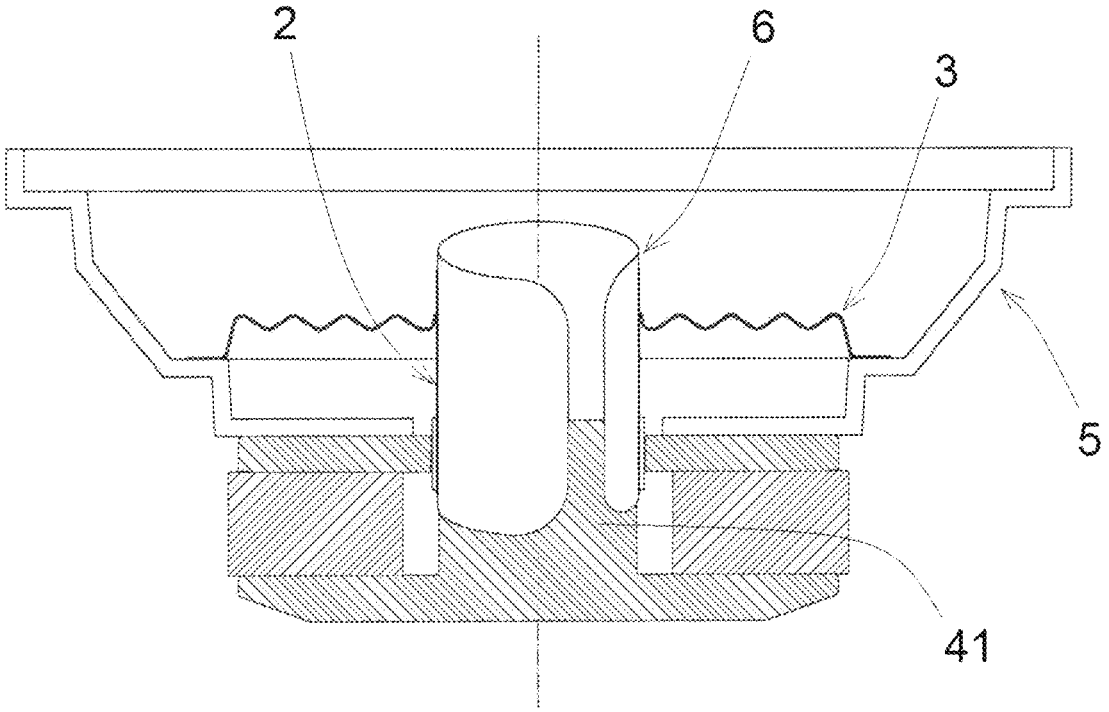
Figure 10:
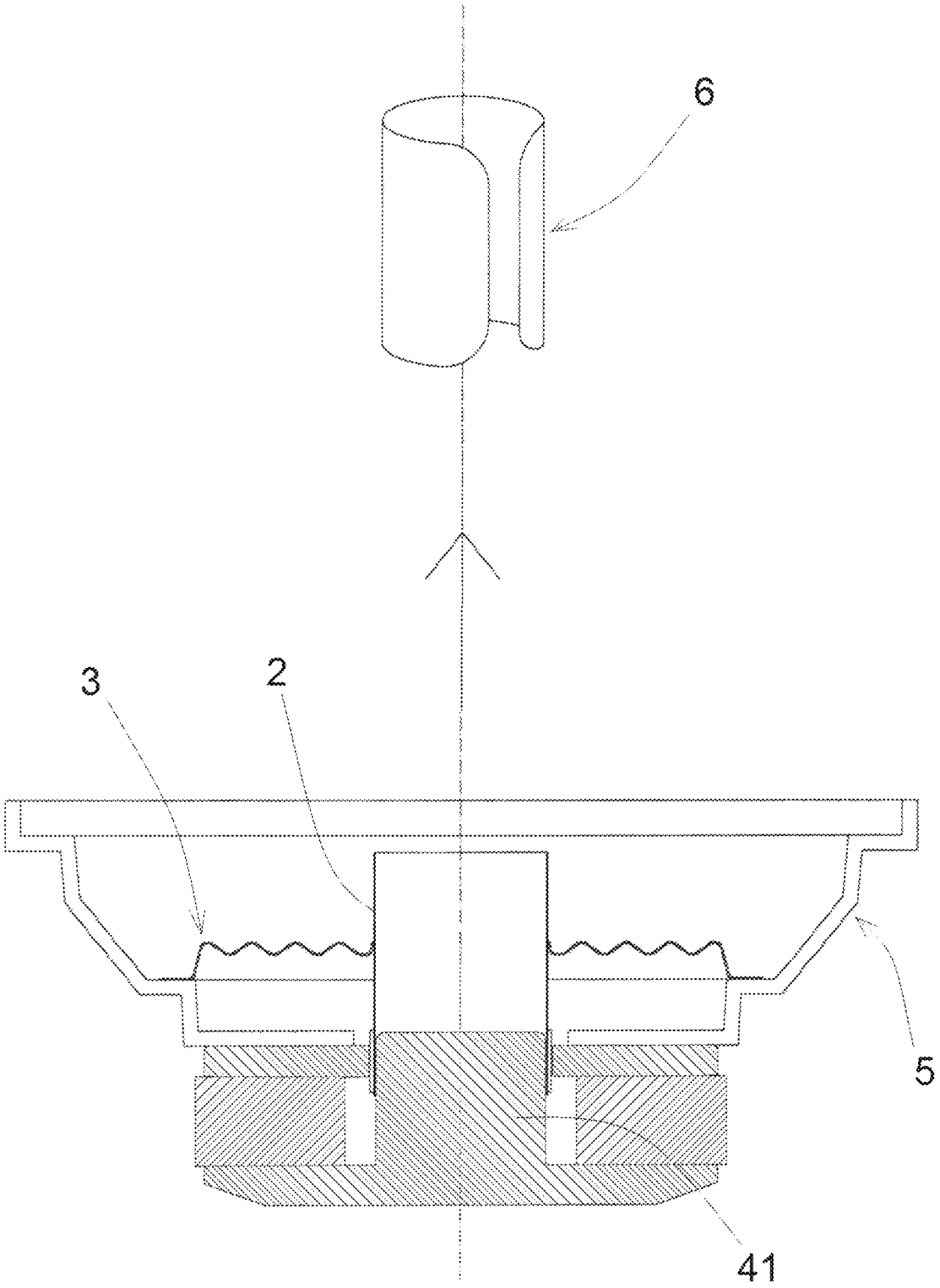
Figure 11:
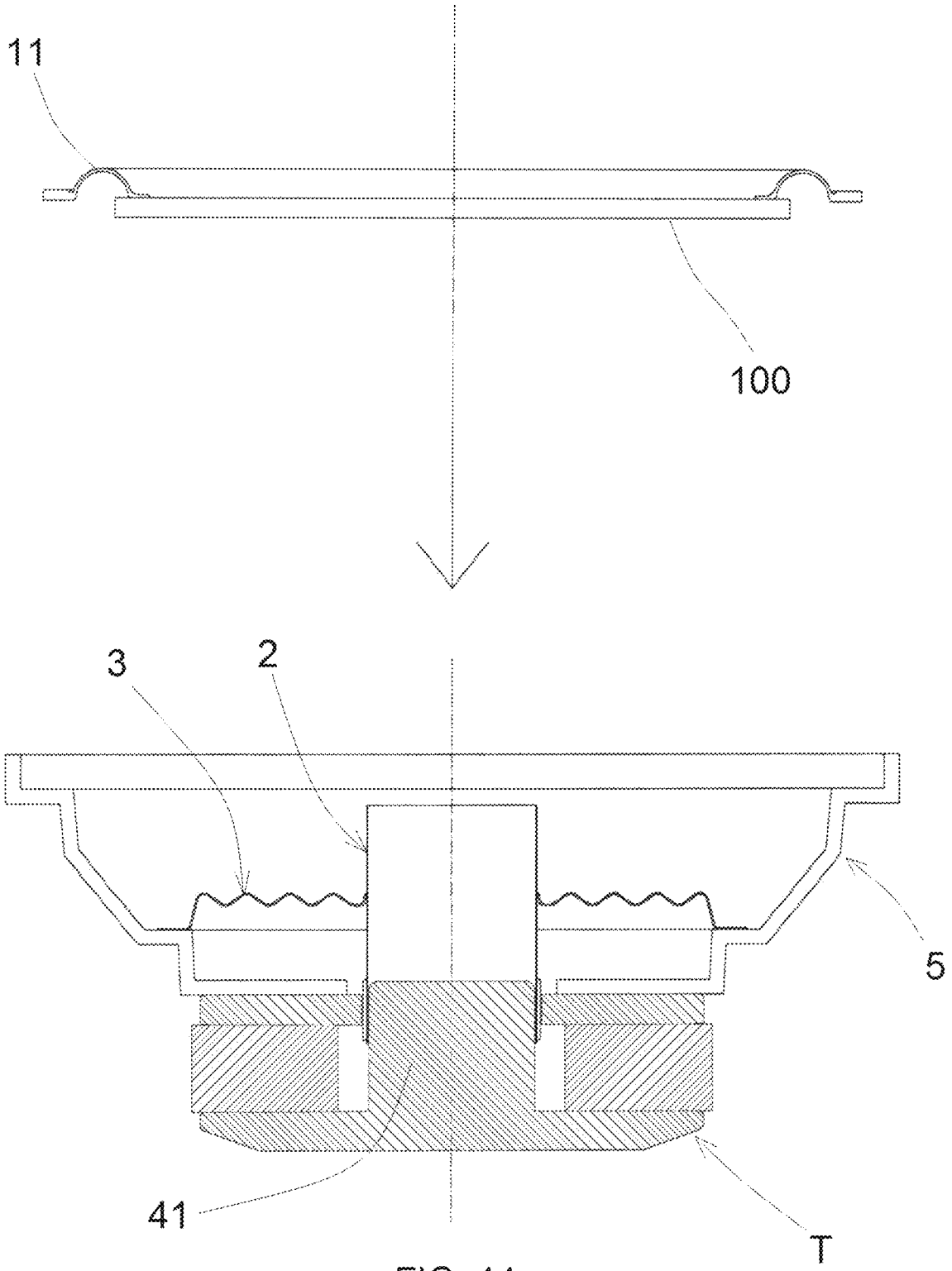
Figure 12:
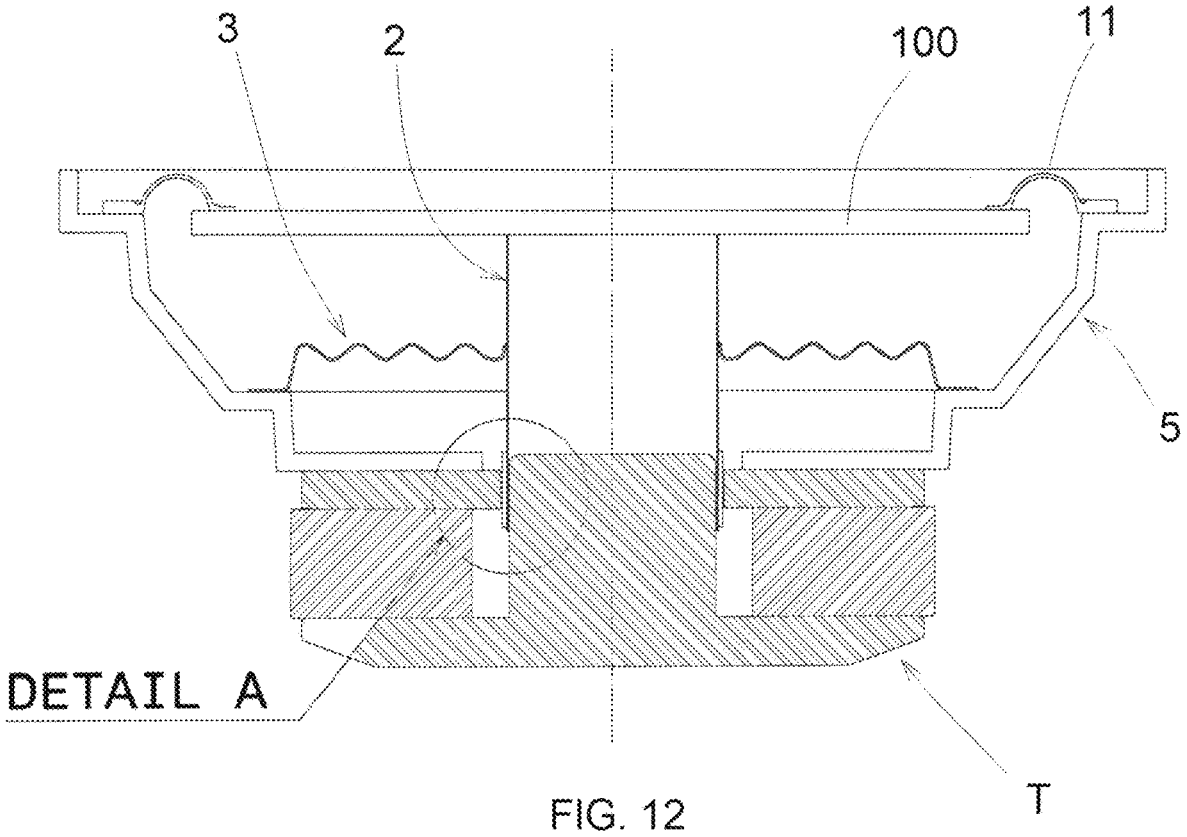
FIG. 12 is a diagrammatic axial view of a loudspeaker with closed membrane, in assembled condition, according to the prior art.
Figure 12A:
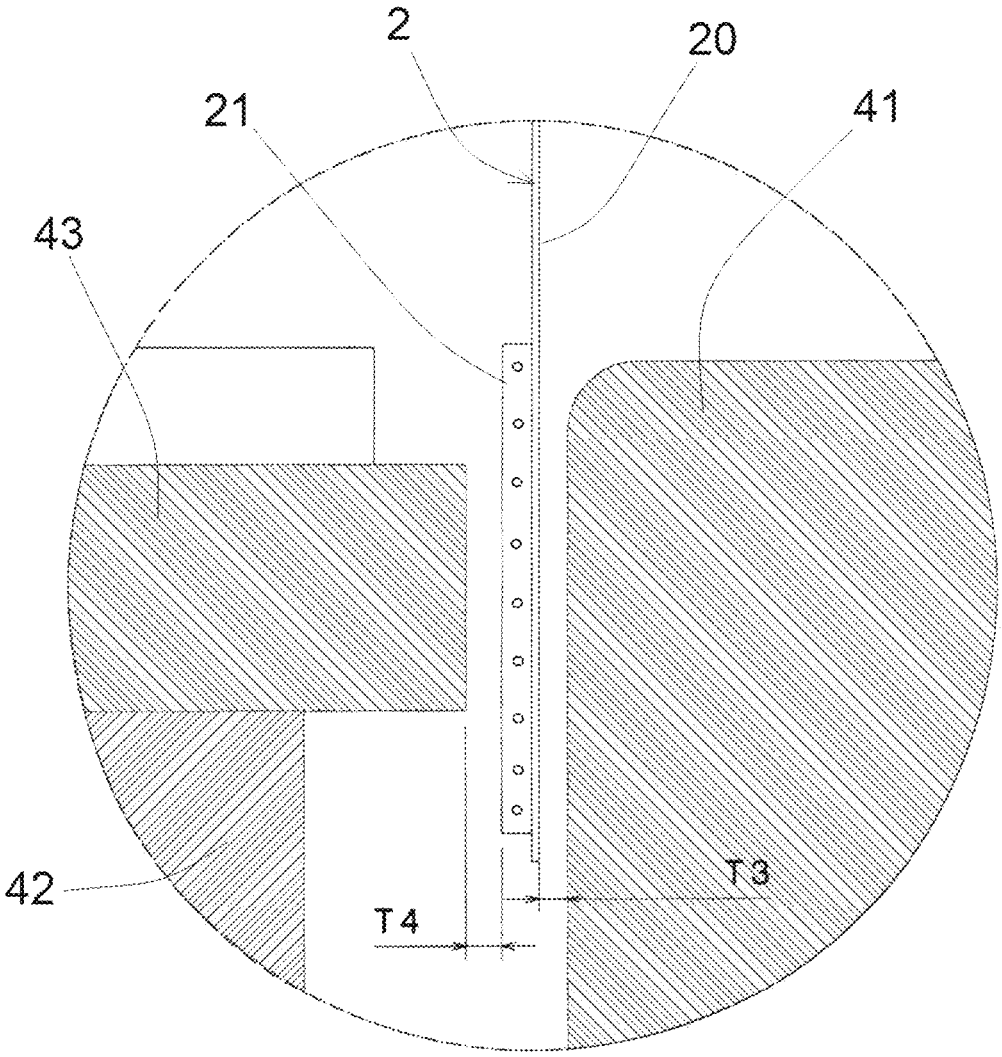
FIG. 12A is an enlarged view of a detail of the loudspeaker of FIG. 12.
Figure 13:
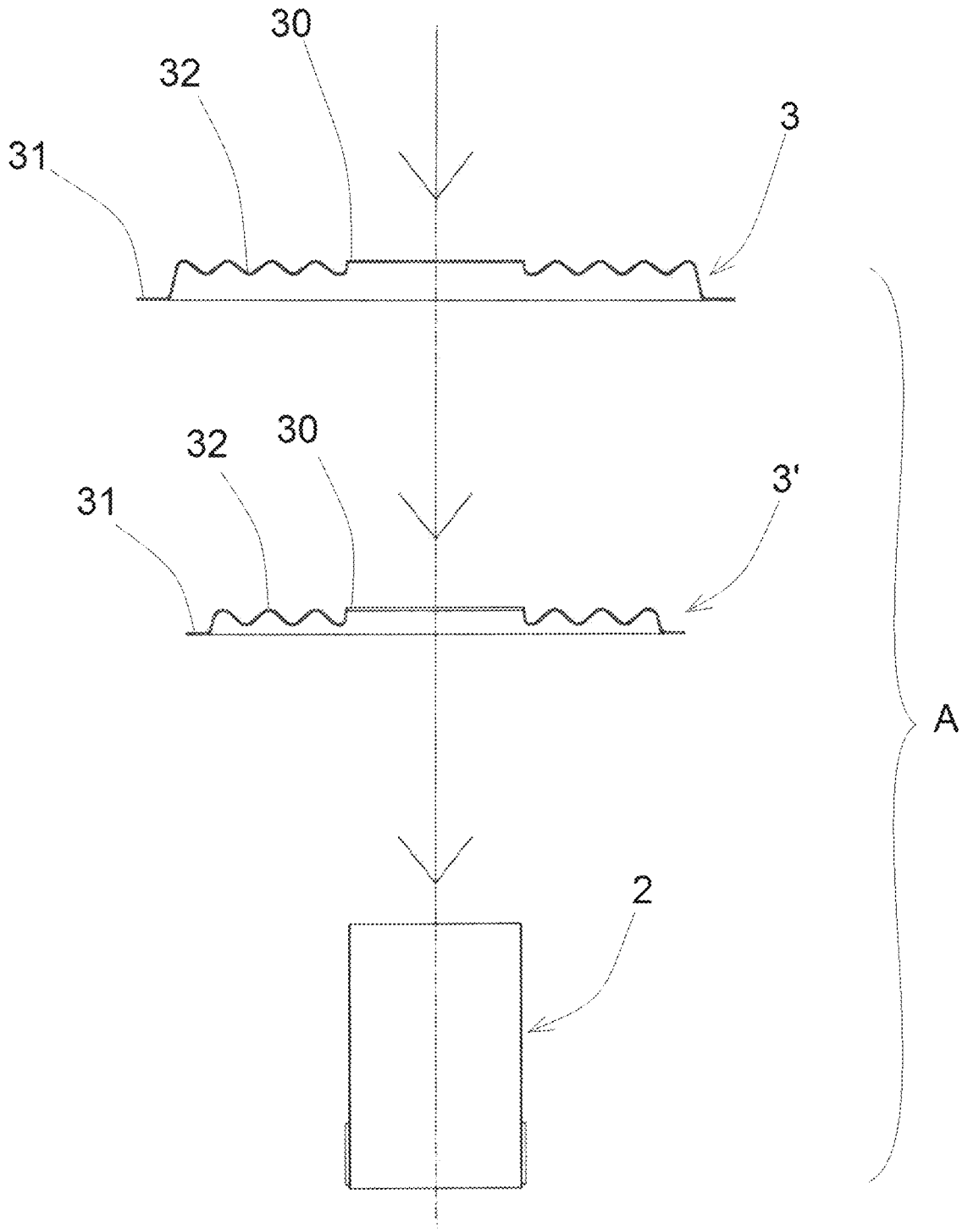
FIGS. 13-17 are diagrammatic axial views showing an assembly method of a loudspeaker with closed membrane, according to the invention.

With reference to FIG. 13, according to the invention, the mobile unit (A) comprises a first centering device (3) and a second centering device (3') that are directly fixed to the cylindrical support (20) of the voice coil (2). Such a mobile unit (A) is pre-assembled.

Figure 14:
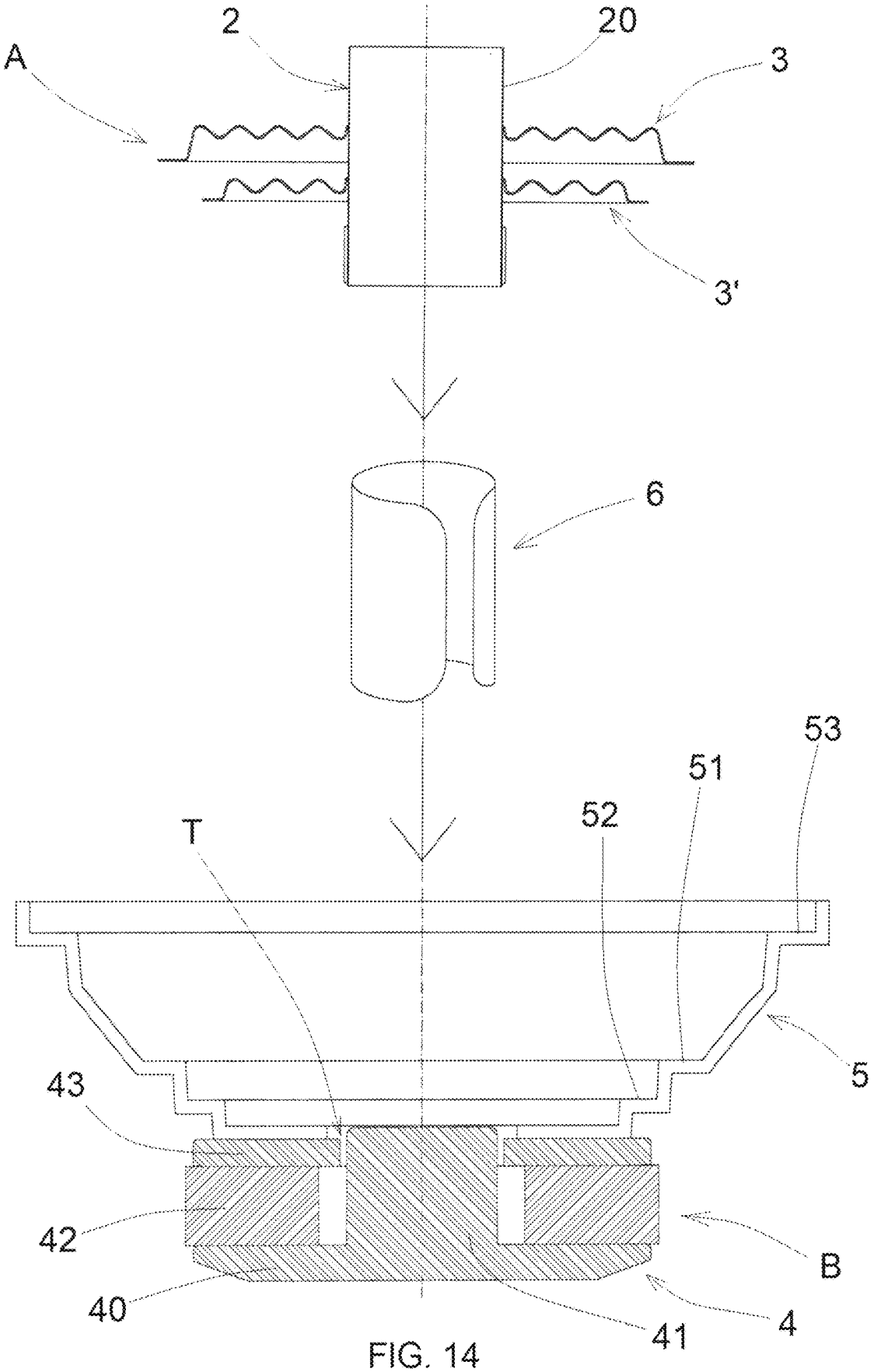

For illustrative purposes, each centering device (3, 3') comprises an internal ring (30), an external ring (31) and a plurality of elastic elements (32) that connect the external ring to the internal ring With reference to FIG. 14, the internal ring (30) of each centering device (3, 3') is fixed to the cylindrical support (2) with glue, in such a way that the centering devices (3, 3') are arranged according to two spaced-out horizontal planes.

The external ring of the first centering device (3) has a higher diameter than the external ring of the second centering device (3').

The fixed unit (B) is pre-assembled. Said fixed unit (B) is substantially similar to a traditional fixed unit. The only difference is represented by the fact that the basket (5) comprises three annular shoulders (51, 52, 53) disposed at three different height levels;

- a first annular shoulder (51) to receive the external ring of the first centering device (3),
- a second annular shoulder (52) to receive the external ring of the second centering device (3'),
- a third annular shoulder (53) to receive the edge (11) of the membrane.

The three annular shoulders (51, 52, 53) are disposed on parallel horizontal planes. The third shoulder (53) is the highest and has the largest diameter. The second shoulder (52) is the lowest and has the smallest diameter.

Figure 15:
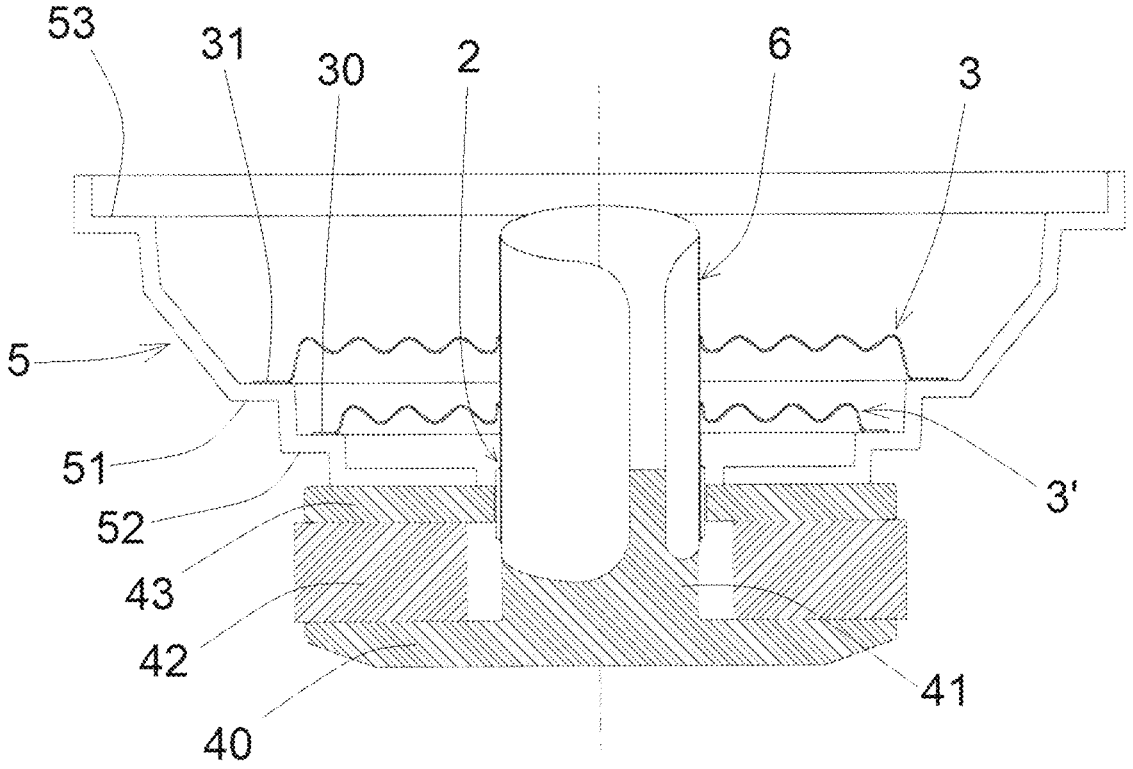

With reference to FIG. 15, the centering device (6) is inserted into the cylindrical support (20) of the voice coil and fitted on the core (41) of the lower polar plate.

The external rings of the first and the second centering device (3, 3') are glued with glue, respectively on the first annular shoulder (51) and on the second annular shoulder (52) of the basket. It must be noted that the voice coil (2) is connected to the basket (5) on two spaced-out gluing planes, in such a way as to ensure a perfect centering of the voice coil (2) in the air gap (T).

Figure 16:
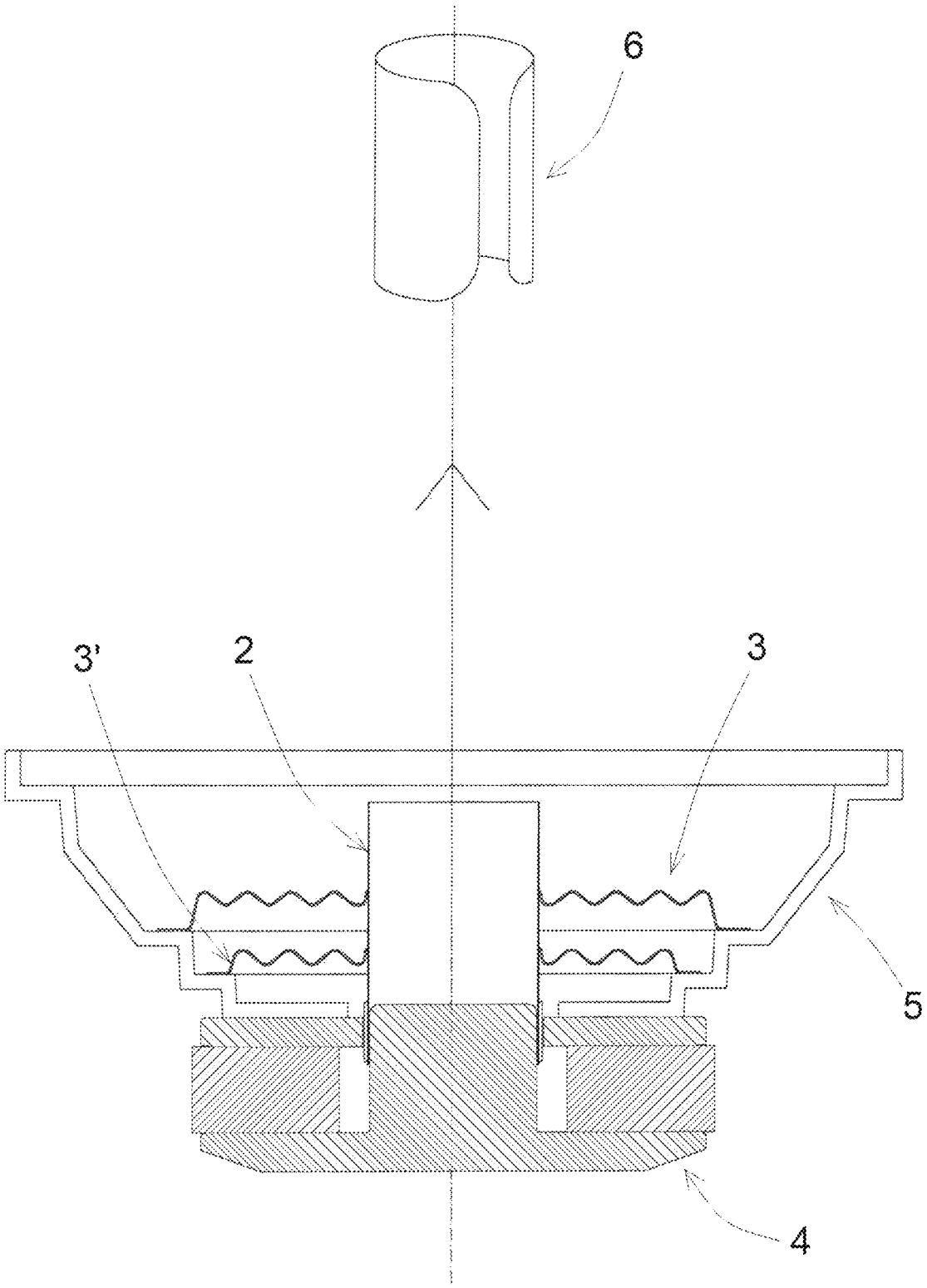

With reference to FIG. 16, after the polymerization of the glue, the centering device (6) is removed, extracting it from the top of the cylindrical support of the voice coil (2).

Figure 17:
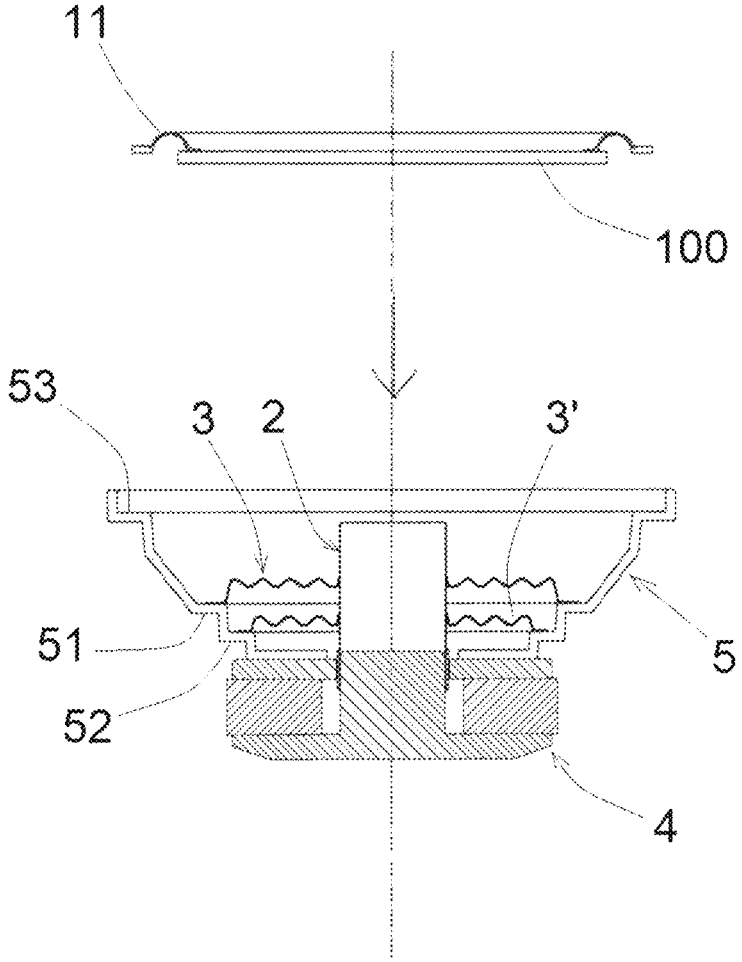

With reference to FIG. 17, after extracting the centering device, the membrane (100) is fixed to the fixed unit (B), by gluing the edge (11) of the membrane to the third shoulder (53) of the basket (5) and the upper edge of the cylindrical support (20) of the voice coil to a central portion of the membrane (100). Therefore, the membrane (100) is directly fixed to the cylindrical support (20) of the voice coil and is a closed membrane because it covers the axial hole of the cylindrical support (20) of the voice coil. It must be noted that the loudspeaker comprises only one membrane (100) that is made in one piece.

Figure 18:
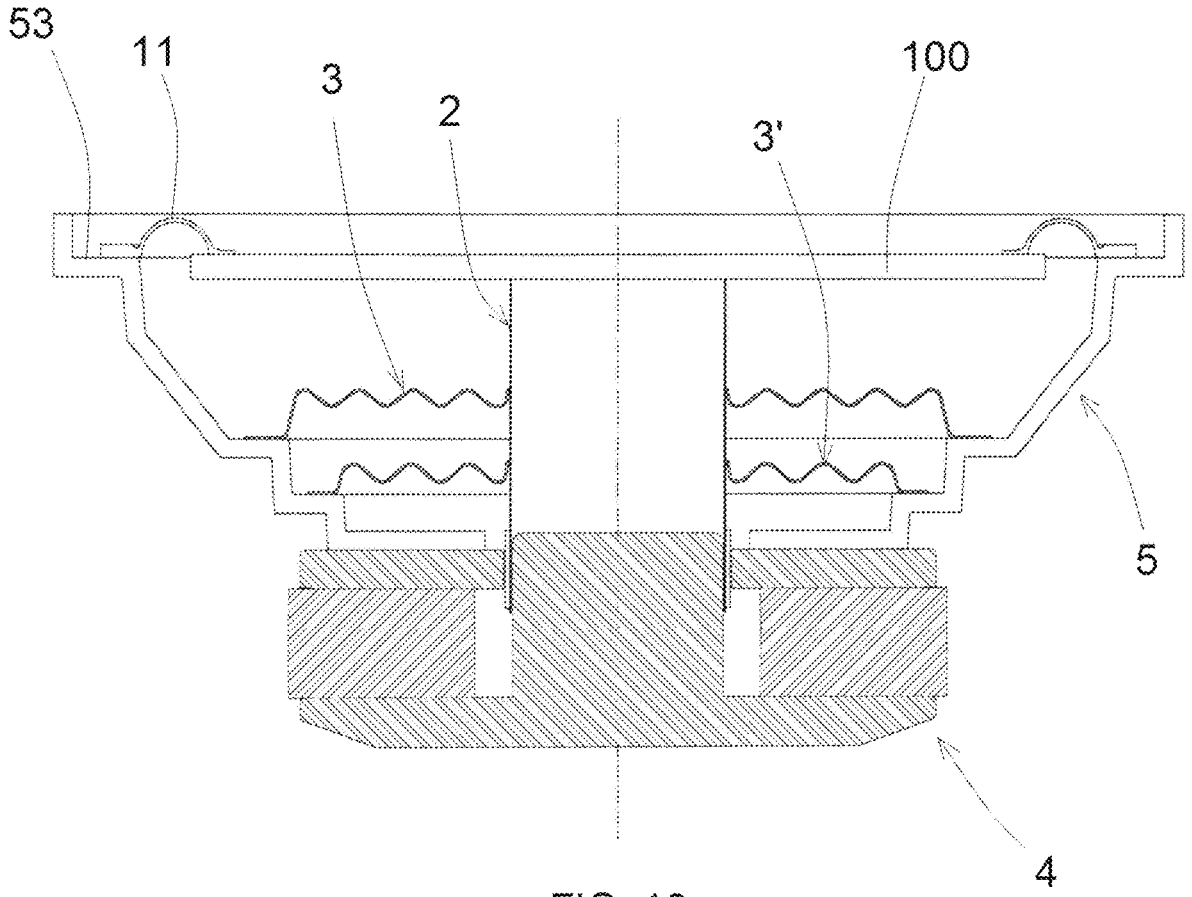
FIG. 18 is a diagrammatic axial view of a loudspeaker with closed membrane, in assembled condition, according to the invention.
Figure 18A:
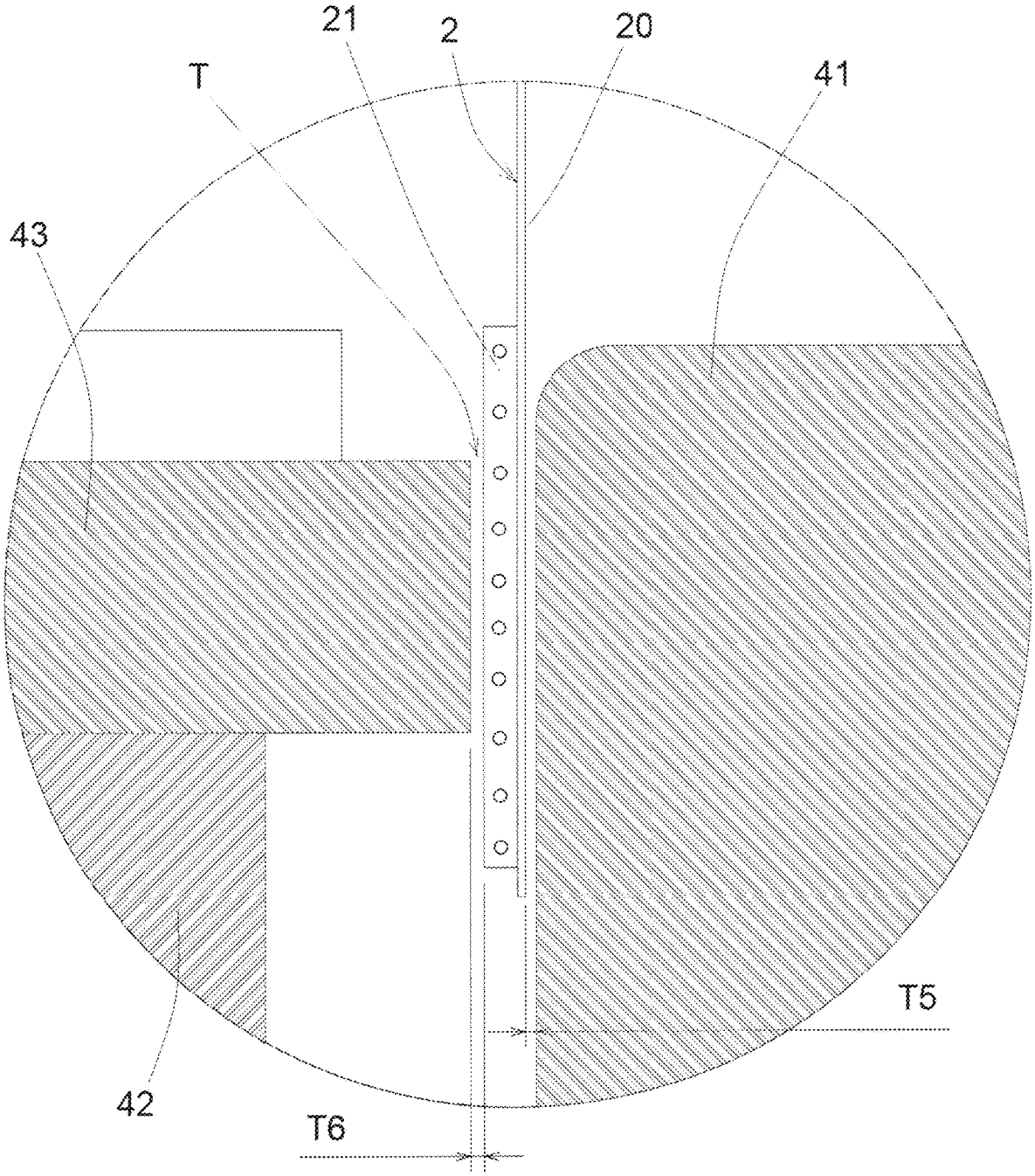
FIG. 18A is an enlarged view of a detail of the loudspeaker of FIG. 18.

With reference to FIGS. 18 and 18A, in such a case of loudspeaker with closed membrane (100) according to the invention, a first distance (T5) is provided between the external surface of the core (41) and the internal surface of the cylindrical support (2) of the voice coil, and a second distance (T6) is provided between the external surface of the winding (21) of the voice coil and the internal surface of the upper polar plate (43).

In such a case, the distances (T5, T6) obtained with the loudspeaker with closed membrane according to the invention are considerably lower than the distances (T3, T4) obtained with loudspeakers with closed membrane according to the prior art and are similar to the distances (T1, T2) obtained with loudspeakers with open membrane.

In view of the above, the loudspeaker with closed membrane according to the invention guarantees a better performance than a loudspeaker with closed membrane according to the prior art, with the same dimensions and the same cost of the magnetic unit.

Table 1 shows the values of the distances (T1, T2, 5 T3, T4, T5, T6) respectively measured in a loudspeaker with open membrane, in a loudspeaker with closed membrane according to the prior art and in a loudspeaker with closed membrane according to the invention, according to the travel of the voice coil. All numerical values in the table are expressed in millimeters.

The term "travel" indicates the axial translation of the voice coil relative to a central fixed horizontal plane, applying a sinusoidal signal to the winding of the voice coil with power equal to the rated power of the loudspeaker.

TABLE 1

| | Loudspeaker with open membrane | | Loudspeaker with closed membrane according to prior art | | Loudspeaker with closed membrane according to invention | |
|---|---|---|---|---|---|---|
| Travel | T1 | T2 | T3 | T4 | T5 | T6 |
| <+3 | 0.1-0.2 | 0.15-0.3 | >0.2 | >0.3 | 0.1-0.2 | 0.15-0.3 |
| ±3-8 | 0.17-0.25 | 0.3-0.5 | >0.25 | >0.5 | 0.17-0.25 | 0.3-0.5 |
| ±8-20 | 0.25-0.35 | 0.4-0.6 | >0.35 | >0.6 | 0.25-0.35 | 0.4-0.6 |

As shown in Table 1, the distances (T5, T6) obtained with the loudspeaker with closed membrane according to the invention are considerably lower than the distances (T3, T4) obtained with loudspeakers with closed membrane according to the prior art and equal to the distances (T1, T2) obtained with loudspeakers with open membrane.

The differences between the loudspeaker with closed membrane according to the invention and the loudspeaker with closed membrane according to the prior art increase when the travel of the voice coil increases.

The loudspeaker according to the invention, with a travel of the voice coil lower than ±3 mm, has a first distance (T5) lower than 0.2 mm and a second distance (T6) lower than 0.3 mm.

The loudspeaker according to the invention, with a travel of the voice coil comprised in the range±3-8 mm, has a first distance (T5) lower than 0.25 mm and a second distance (T6) lower than 0.5 mm.

The loudspeaker according to the invention, with a travel of the voice coil comprised in the range±8-20 mm, has a first distance (T5) lower than 0.35 mm and a second distance (T6) lower than 0.6 mm.

Numerous equivalent variations and modifications can be made to the present embodiments of the invention, which are within the reach of an expert of the field and fall in any case within the scope of the invention as disclosed by the attached claims.

We claim:

1. A method of assembling a closed membrane loudspeaker, the method comprising:

preassembling a mobile unit having a voice coil with a cylindrical support upon which at least one winding is wound, the step of preassembling comprising fixing a first centering device and a second centering device directly to the cylindrical support;

preassembling a fixed unit having a basket and a magnetic unit, the magnetic unit having a lower polar plate with a core in which an annular magnet is disposed around the core and an annular upper polar plate disposed on the annular magnet and around the core so as to form an air gap;

inserting a cylindrical temporary centering device into the cylindrical support so as to fit onto the core of the lower polar plate such that the voice coil is centered in the air gap between the core and the annular magnet and the annular upper polar plate;

gluing the mobile unit to the basket of the fixed unit, the step of gluing comprising gluing the first centering device and the second centering device to the basket such that the first and second centering devices are disposed along parallel plans such that the voice coil is centered in the air gap and minimizes a first distance between an external surface of the core and an internal surface of the cylindrical support and a second distance between an external surface of the winding of the voice coil and an internal surface of the upper polar plate;

extracting the cylindrical temporary centering device from the voice coil;

gluing an edge of a closed membrane to the basket; and gluing a central portion of the closed membrane directly to the cylindrical support of the voice coil.

2. The method of claim 1, wherein each of the first and second centering devices has an internal ring, an external ring and a plurality of elastic elements that connect the external ring to the internal ring, the step of preassembling the mobile unit comprising:

fixing the internal ring of the each of the first and second centering devices to the cylindrical support, the step of gluing the mobile unit to the basket comprising:

gluing the external ring of each of the first and second centering devices to the first annular shoulder and to a second annular shoulder of the basket, wherein the first and second annular shoulder of the basket are disposed along parallel planes at different levels.

3. The method of claim 2, the step of gluing the edge of the closed membrane to the basket comprising:

gluing the edge of the closed membrane to a third annular shoulder of the basket, wherein the first annular shoulder and the second annular shoulder and the third annular shoulder of the basket are disposed along parallel plans at the different levels.

4. A loudspeaker comprising:

a magnetic unit having an upper polar plate with a core, the core having an annular magnet disposed therearound, the annular magnet having the annular upper polar plate disposed thereon, the annular upper polar plate being positioned around the core, wherein an air gap is formed between the core and the annular magnet and the annular upper polar plate;

a basket fixed to said magnetic unit;

a voice coil having a cylindrical support whereon at least one winding is wound, the cylindrical support having an axial through hole;

a first centering device directly fixed to the cylindrical support of said voice coil and to the basket so that said voice coil is centered on the air gap;

a single closed membrane formed as a single piece, the single closed membrane being centrally fixed directly to the cylindrical support of said voice coil and peripherally fixed to an edge of said basket such that the single closed membrane covers the axial through hole of the cylindrical support; and a second centering device directly fixed to the cylindrical support of said voice coil and to said basket such that said first centering device and said second centering device are disposed along parallel planes so as to minimize a first distance between an external surface of the core and an internal surface of the cylindrical support of said voice coil and a second distance between an external surface of the winding of said voice coil and an internal surface of the upper polar plate.

5. The loudspeaker of claim 4, wherein each of said first centering device and said second centering device has an internal ring, an external ring and a plurality of elastic elements that connect the external ring to the internal ring, wherein the internal ring is fixed to the cylindrical support, wherein the external ring is fixed to the first annular shoulder and to the second annular shoulder of said basket, the first and second annular shoulder of said basket being disposed along parallel planes at different levels.

6. The loudspeaker of claim 5, wherein said basket comprises a third annular shoulder, wherein the first annular shoulder and the second annular shoulder and the third annular shoulder are disposed along parallel planes at different levels.

7. The loudspeaker of claim 4, said voice coil having a travel less than 3 millimeters, the first distance being less than 0.2 millimeters, the second distance being less than 0.3 millimeters.

8. The loudspeaker of claim 4, said voice coil having a travel of between 3 and 8 millimeters, said first distance being less than 0.25 millimeters, the second distance being less than 0.5 millimeters.

9. The loudspeaker of claim 4, said voice coil having a travel of between 8 and 20 millimeters, said first distance being less than 0.35 millimeters, said second distance being less than 0.6 millimeters.

* * * * *